United States Patent [19]

Kitayama et al.

[11] Patent Number: 4,610,022

[45] Date of Patent: Sep. 2, 1986

[54] VOICE ENCODING AND DECODING DEVICE

[75] Inventors: Seishi Kitayama; Fumihiro Yato; Akira Kurematsu, all of Tokyo, Japan

[73] Assignee: Kokusai Denshin Denwa Co., Ltd., Tokyo, Japan

[21] Appl. No.: 449,760

[22] Filed: Dec. 14, 1982

[30] Foreign Application Priority Data

Dec. 15, 1981 [JP] Japan ..... 56-200852

[51] Int. Cl.[4] ..... G10L 5/00

[52] U.S. Cl. ..... 381/36

[58] Field of Search ..... 381/41–43, 381/36, 37, 38, 39, 40

[56] References Cited

U.S. PATENT DOCUMENTS 3,750,024 7/1973 Dunn et al. ..... 381/41

*Primary Examiner*—E. S. Matt Kemeny

[57] ABSTRACT

In a speech transmission or storage system using LPC parameters and a Baseband Signal derived from the prediction error signal, the synthesis excitation signal is formed from the baseband plus high-frequency regeneration, which is then spectrum-flattened for proper synthesis.

4 Claims, 17 Drawing Figures

PRIOR ART

FIG. 4(a)
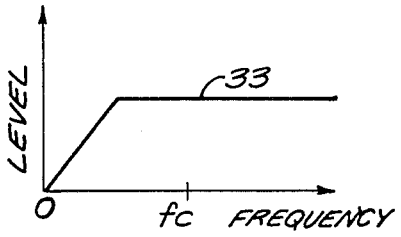
FIG. 4(b)
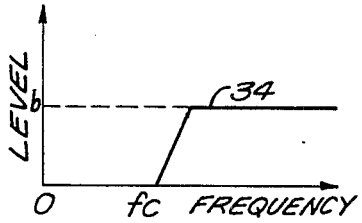
FIG. 4(c)
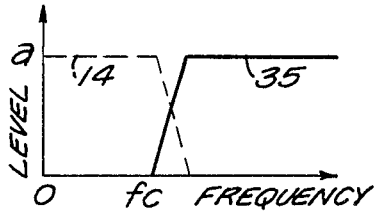
FIG. 4(d)
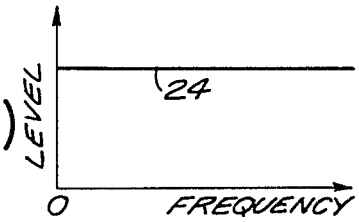
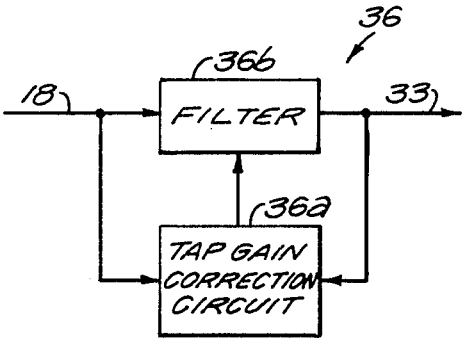
FIG. 5
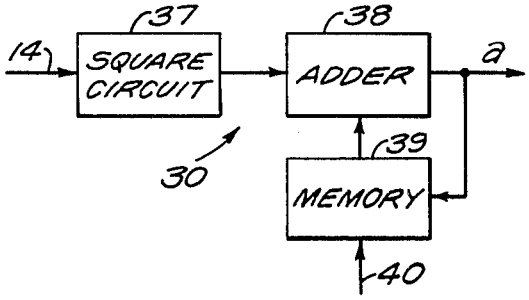
FIG. 6
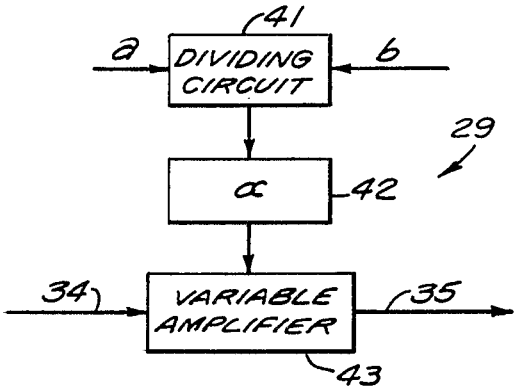
FIG. 7

VOICE ENCODING AND DECODING DEVICE

BACKGROUND OF THE INVENTION (1) Field of the Invention

This invention relates to a voice encoding and decoding device.

(2) Description of a Prior Art

For encoding and decoding a voice for the purpose of transmission and storage of voice information, a voice encoding and decoding device intitally separates an input voice which is expressed either in analog or digital signals into a predictive parameter and a predictive error signal.

The predictive parameter is encoded directly and transmitted or stored. As to the predictive error signal, because it has a flat and very wide frequency spectrum, a base band component of the predictive error signal is only extracted and encoded and transmitted or stored. Thereafter, the encoded signal of the predictive parameter and the base band component are decoded. A reproduced voice will be principally composed by controlling the predictive error signal per se with the predictive parameter.

However, the base band component of the predictive error signal is only obtainable by decoding the transmitted or stored signals. A higher frequency component must be prepared from the base band component and added to the base band component for generating an exciting signal which is used instead of the predictive error signal. As the exciting signal thus obtained has a frequency sprectrum not as flat as that of the original predictive error signal, a satisfactory composite voice is not obtainable.

In the prior art mentioned above, the frequency characteristics of an emphasis circuit and the gain of an amplifier which amplifies the output signal of the emphasis circuit must be set to make the mean value of the exciting signal as flat as possible over a long time period in order to obtain a satisfactory composite voice.

FIG. 1 shows a circuit diagram of a conventional voice encoding and decoding device.

FIG. 2 shows frequency characteristics of main portions of the circuit shown in FIG. 1. For facilitating the explanation, the input voice signal 1 is described as an analog signal, but it may be described also as a digital signal. In FIG. 1, an fed input voice signal 1 input to a predictor 2 is processed to produce a predictive parameter 3 by means of a linear predictor 2*a*. A predictive error signal 5 is obtained by controlling the frequency characteristics of a filter 2*c* inputting the voice, such as a transversal filter, with an encoded predictive parameter 4 which has previously been encoded by an encoder 2*b*. As a voice is considered that it is formed from an impulsive sound and a white noise filtered through a filter of a throat and a mouth, a voice can be expressed by an impulsive sound, a white noise and frequency characteristics of such a filter composed of a throat and mouth. The linear predictor 2*a* predicts the frequency characteristics of such a filter and the predictive parameter 3 expresses these characteristics. The frequency characteristics of the filter 2*c* is controlled by an encoded predictive parameter 4 so as to have the characteristic opposite to those of a filter composed of a throat and the like. For this reason, the more accurate the prediction is, the more identical the output of the filter 2*c* namely a predictive error signal 5 becomes with either an original wave form of an impulsive sound or that of a white noise, and consequently the frequency spectrum of the predictive error signal 5 is made flat as shown in FIG. 2(*a*). The reason for controlling the frequency characteristics of the filter 2*c* with the predictive parameter 4 is to absorb quantization errors produced in encoding into the predictive error signal 5. A number of bits is required, if a predictive error signal 5 is directly encoded.

Therefore, as is shown in FIG. 2(*b*), a base band component 7 is extracted alone from the predictive error signal by a low-pass filter 6 having for example fc=800 Hz as shown and is encoded by an encoder 8. This encoded base band component 9 and the above mentioned encoded predictive parameter 4 are used for transmission or storage. Reference numeral 10 denotes a transmission line or a memory. The high frequency component of the predictive error signal 5 which has been removed by the low-pass filter 6 is reproduced from the base band component for supplement when composing a voice in such a manner as mentioned hereinafter.

After having transmitted or storaged the encoded base band component 9 and the encoded predictive parameter 4, they are decoded by decoders 11 and 12 respectively. The output of the decoder 11 is freed from the decoded noise by a low-pass filter 13 and becomes a decoded base band component 14 which is the same as the original base band component 7. This decoded base band component 14 is input to a non-linear circuit 15 which generates a signal 16 having a higher harmonics component as shown in FIG. 2(*c*). The signal 16 is input to an emphasis circuit 17 for emphasizing the high frequency component of the signal 16 to get a signal 18 having an emphasized high frequency component as shown in FIG. 2(*d*). The signal 18 is then supplied to a high-pass filter 19 to make the high frequency component 20 as shown in FIG. 2(*e*) which has been removed by the low-pass filter 6 or 13. This high frequency component 20 is amplified by an amplifier 21 to get a high frequency component 22 for supplement of the band component 14. The high frequency component 22 is added to the base band component 14 by an adder circuit 23 to get an exciting signal 24.

A voice composing filter 25, for example, a transversal filter whose frequency characteristics are controlled by the decoded predictive parameter 26 to be made frequency characteristics which are substantially the same as those of the filter composed of a throat and the like composes and outputs a reproduced voice sound by passing the exciting signal 24. The voice composing filter 25 is also possible to be controlled directly by the encoded predictive parameter 4. However, as the frequency characteristics of the emphasis circuit 17 and the gain of the amplifier 21 are determined in such a manner that the meanvalue of the frequency spectrum of the exciting signal 24 is made flat over a long time period as has been mentioned above, the frequency spectrum over a short time period is not flat as is shown in FIG. 2(*f*). This causes the inferior quality of the composite voice of such a conventional device as explained above.

SUMMARY OF THE INVENTION

The object of the present invention is to provide a voice encoding and decoding device having a flat frequency spectrum over the short time period of the exciting signal excluding defects of the conventional type.

According to the present invention, a voice encoding and decoding device is provided wherein, in a voice encoding and decoding device having a predictor analyzing an input voice to a predictive parameter by means of a linear predictor of the predictor and a predictive error signal by means of a filter whose frequency characteristic is controlled by the encoded predictive parameter by a encoder of the predictor, a low pass filter which passes only the base band component of the predictive error signal, an encoder which encodes the base band component of the predictive error signal, transmission line or memory which transmits or stores the encoded base band component and the encoded predictive parameter, a decoder which decodes the encoded base band component and another decoder which decodes the encoded predictive parameter, a low pass filter which passes the base band component, a nonlinear circuit which produces a higher harmonic component of the base band component, emphasis circuit which emphasizes the high frequency range of the higher harmonics component to get a high frequency component, an amplifier which amplifies the high frequency component corresponding to the level of the base band component, an adder circuit which adds the base band component to the high frequency component to get an exciting signal and a voice composing filter whose frequency characteristic is controlled by the encoded or decoded predictive parameter passes the exciting signal to output a composite voice, between said emphasis circuit and said amplifier, a predictor is disposed for making flat the frequency characteristics of the higher harmonic component, and a level detector means are disposed in relation to said amplifier for supplying a gain controlling signal to said amplifier align to the level of the base band component.

According to the present invention, even though fewer bits are enough to encode voice, a higher quality composite voice is obtainable, therefore, it is not necessary to use a transmission line of larger capacity or more memories for transmitting or storing the same quality information of voice as the conventional. Another advantages of the present invention will be apparent from the description which follows.

BRIEF EXPLANATION OF THE DRAWINGS

FIGS. 4(*a*) to 4(*d*) show frequency spectrums of the signals at the main parts of the circuit shown in FIG. 3.

FIG. 5 shows another type of the predictor.

FIG. 6 shows a circuit diagram of a type of level measurement means.

FIG. 7 shows a circuit diagram of a type of variable gain amplifier.

DETAILED EXPLANATION OF THE INVENTION

Figure 1:
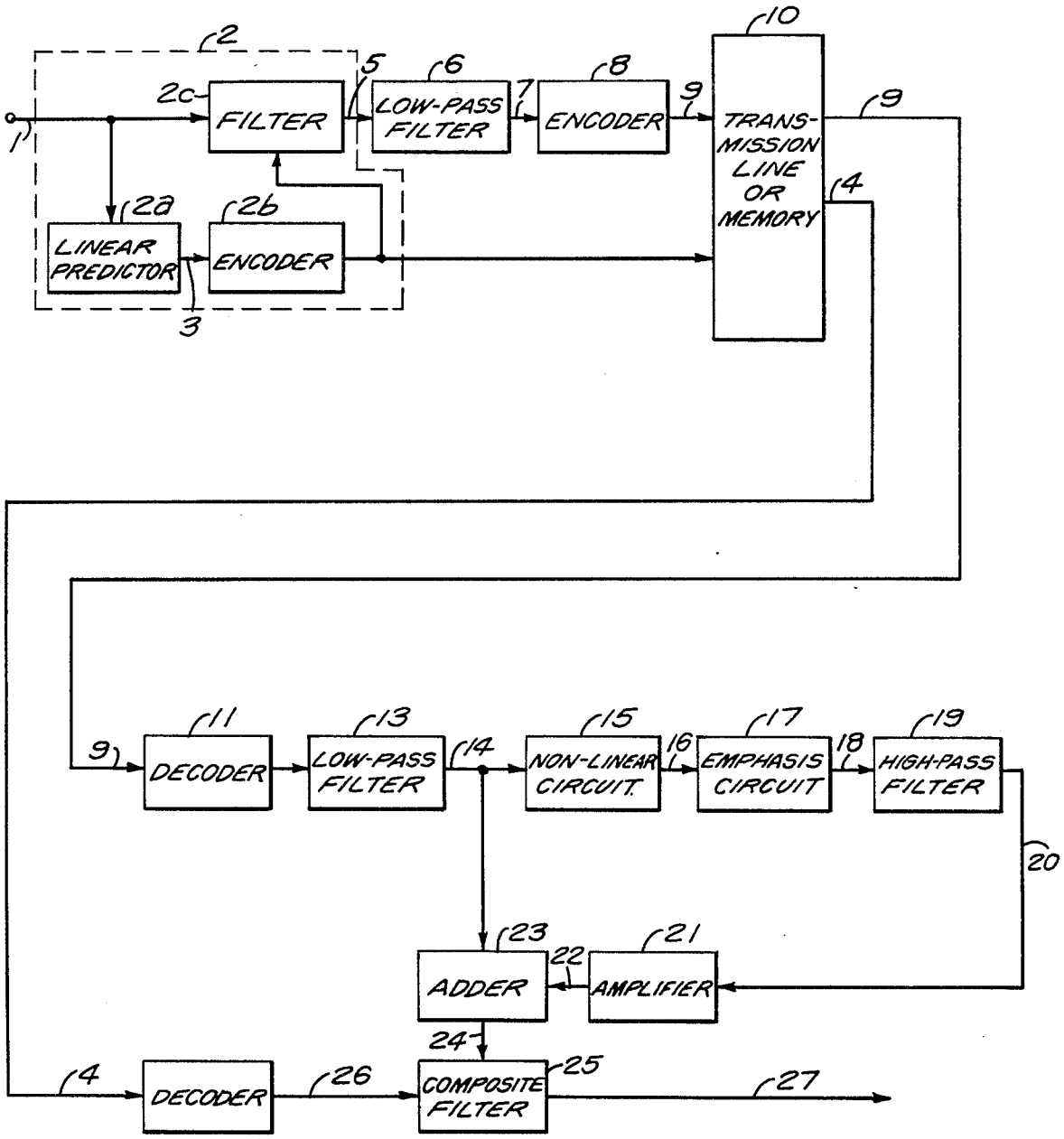
(PRIOR ART) FIG. 1
FIG. 1 shows a circuit diagram of a conventional voice encoding and decoding device.
Figure 2A:
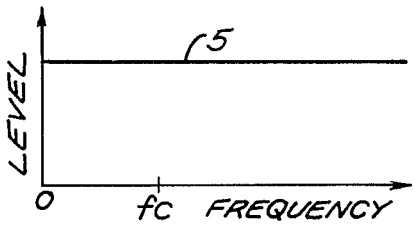
FIGS. 2(*a*) to 2(*f*) show frequency spectrums of the signals at the main parts of the circuit shown in FIG. 1.
Figure 2B:
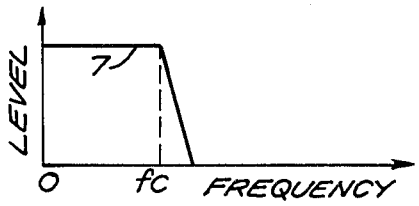
Figure 2C:
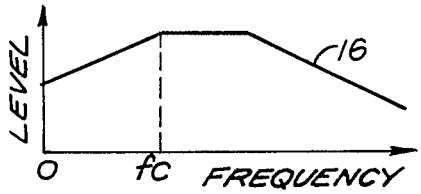
Figure 2D:
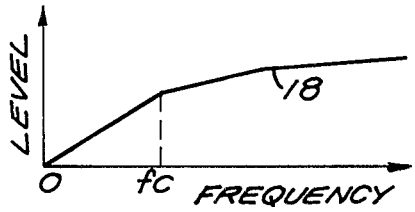
Figure 2E:
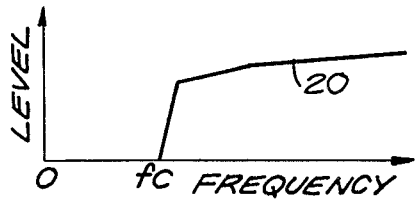
Figure 2F:
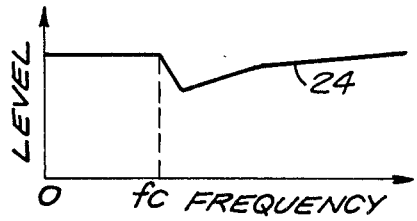
Figure 3:
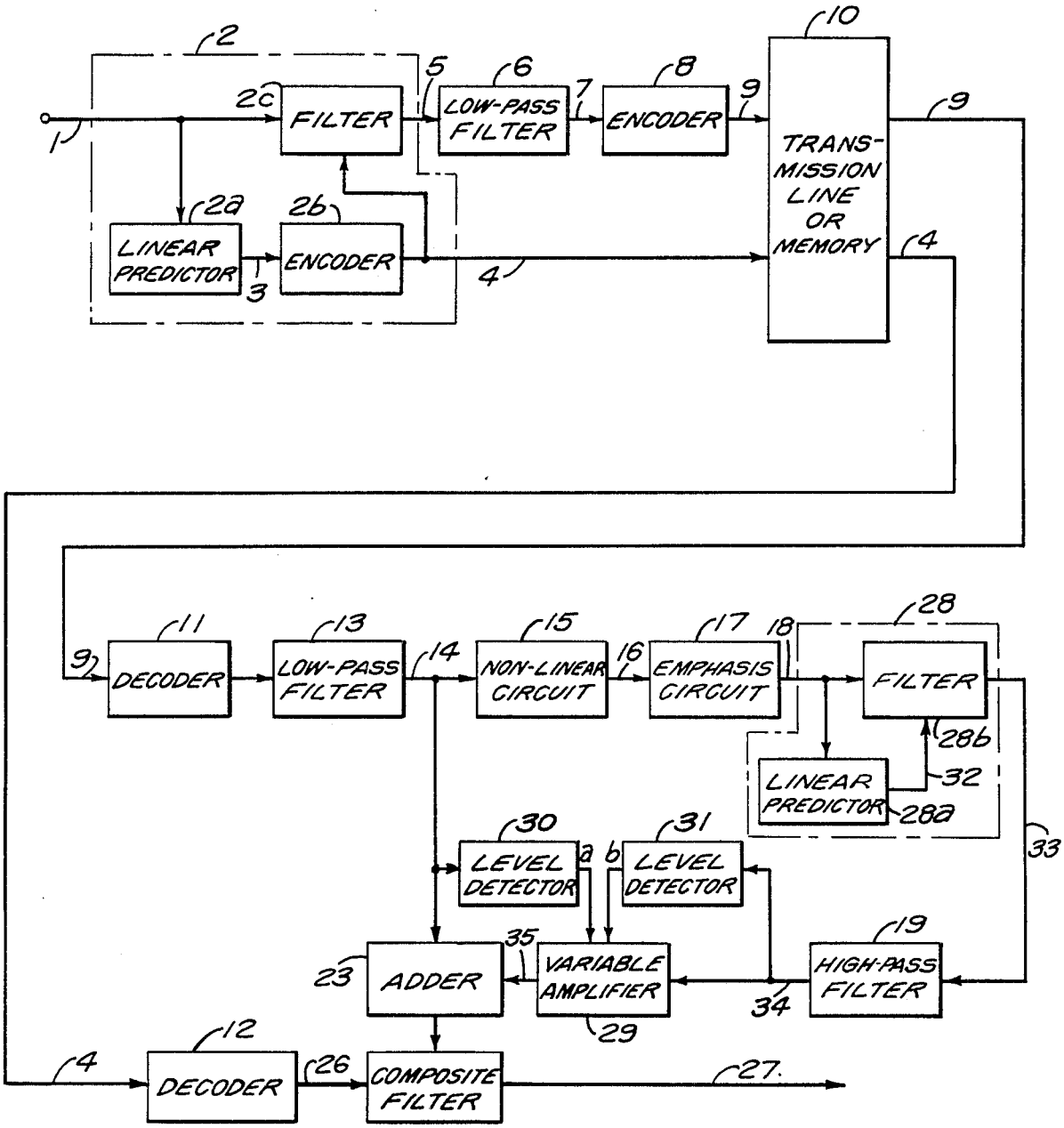
FIG. 3 shows a circuit diagram of an embodiment of the present invention.

FIG. 3 shows a circuit diagram of a voice encoding and decoding device of the present invention which is different from the conventional device of FIG. 1 in that a predictor 28 is provided at the step next to the emphasis circuit 17, a variable gain amplifier 29 is employed instead of the amplifier 21, and the gain of the variable gain amplifier 29 is controlled by the outputs a and b of two level detectors 30 and 31 forming a level difference detecting means. The parts of the circuit shown in FIG. 3 which differ from the conventional circuit shown in FIG. 1 are described as follows; a predictor 28 which function as the predictor 2 for the input signal which comprises a linear predictor 28*a* and a filter 28*b* whose characteristics can be controlled by a predictive parameter 32 of the output of the linear predictor 28*a* as a transversal filter, but it is not necessary to encode the predictive parameter 32. A high frequency emphasized component 18, therefore, will be converted to a signal 33 having a flat range frequency spectrum by the operation of the predictor 28 as shown in FIG. 4(*a*). The signal 33 is input to a high-pass filter 19 as done in the conventional art to get a high frequency component 34 having a flat spectrum as shown in FIG. 4(*b*). The high frequency component 34 has a signal level b which is not generally equal to the level a of the base band component 14 of the output of the decoder 11.

The levels a and b of these component 14 and 34 are measured by the two level detectors 30 and 31 respectively, the output signals of two level detectors 30, 31 being fed to the variable gain amplifier 29, and then the variable gain amplifier 29 is operated by the gain proportional to the difference of the levels (a-b). This makes the level of the high frequency component 35 from the variable amplifier 29 equal to that of the base band component 14 as shown in FIG. 4(*c*) and the exciting signal 24 has a flat frequency spectrum as shown in FIG. 4(*d*). As a result, the quality of the composite voice is remarkably improved. As the predictor 28, a learning type predictor 36 as shown in FIG. 5 may be also employed instead of the linear predicting type predictor 28 shown in FIG. 3. In FIG. 5, reference numeral 36*a* denotes a tap gain correction circuit, 36*b* a filter whose frequency characteristic is controlled by the output signal of the tap gain correction circuit 36*a*.

As the level detectors 30 and 31, a power operational circuit which consists of a squaring circuit 37, an adder circuit 38 and a memory 39 may be used as shown in FIG. 6. Reference numeral 40 denotes a clearing signal in FIG. 6. As the variable gain amplifier 29, such a circuit as shown in FIG. 7 which consists of a level dividing circuit 41, a gain decision circuit 42 setting the gain $\alpha$ and an amplifier 43 whose gain is controlled by the gain decision circuit 42 may be employed.

Figure 8:
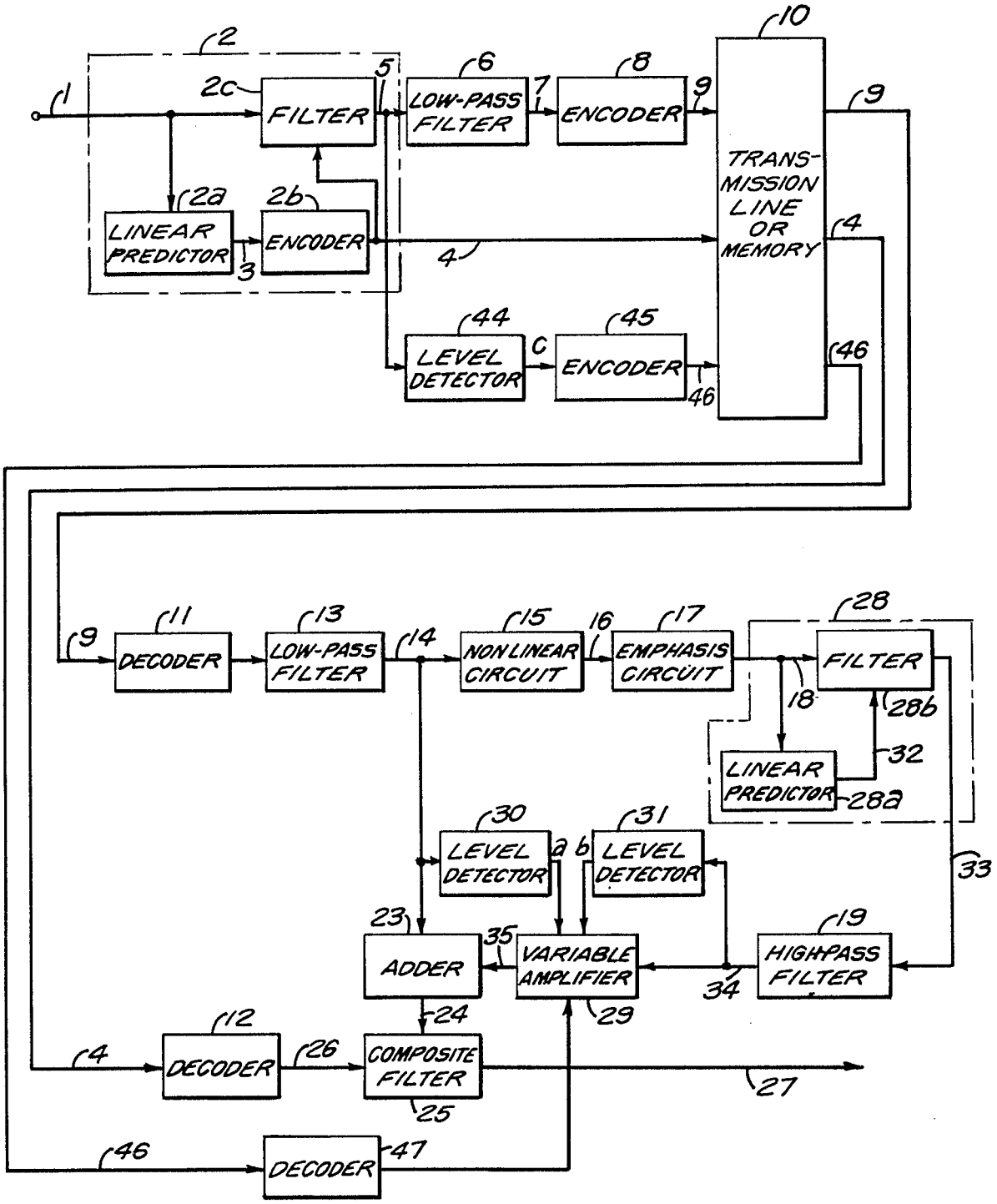
FIGS. 8 and 9 show circuit diagrams of other embodiments of the present invention.

FIG. 8 shows another embodiment of the present invention which is different from the embodiment in FIG. 3 in that the level c of the predictive error signal 5 on the encoding side is also used for controlling the gain of the variable gain amplifier 29. In other words, for making the frequency spectrum of the exciting signal 24 flat, as the level of the amplified high frequency component 35 after the variable gain amplifier 29 must be adjusted to the level difference (c-a) obtained by subtracting the level a of the base band component 14 from the level c of the predictive error signal 5, the high frequency component having the level b of the input signal should be amplified by the gain c-a/b of the variable gain amplifier. In the case of this embodiment, as the level measuring means 44 is placed on the encoding side, an encoder 45 encoding the level c, the transmission line or memory for the encoded level 46 and the decoder 47 for the decoded level 46 are required. However, as the number of bit required for the encoded level 46 is quite limited, the amount of information will not increase substantially.

Adversely, if the quality of composite voice cam be compromised to be at the same level as obtained by prior art, as the number of bits for encoding the predictive parameter 4 and the encoded base band component 9 can be reduced by the amount achieved by the improvement flattening the frequency spectrum of the exciting signal 24, the whole amount of the information of the system is remarkably reduced.

Figure 9:
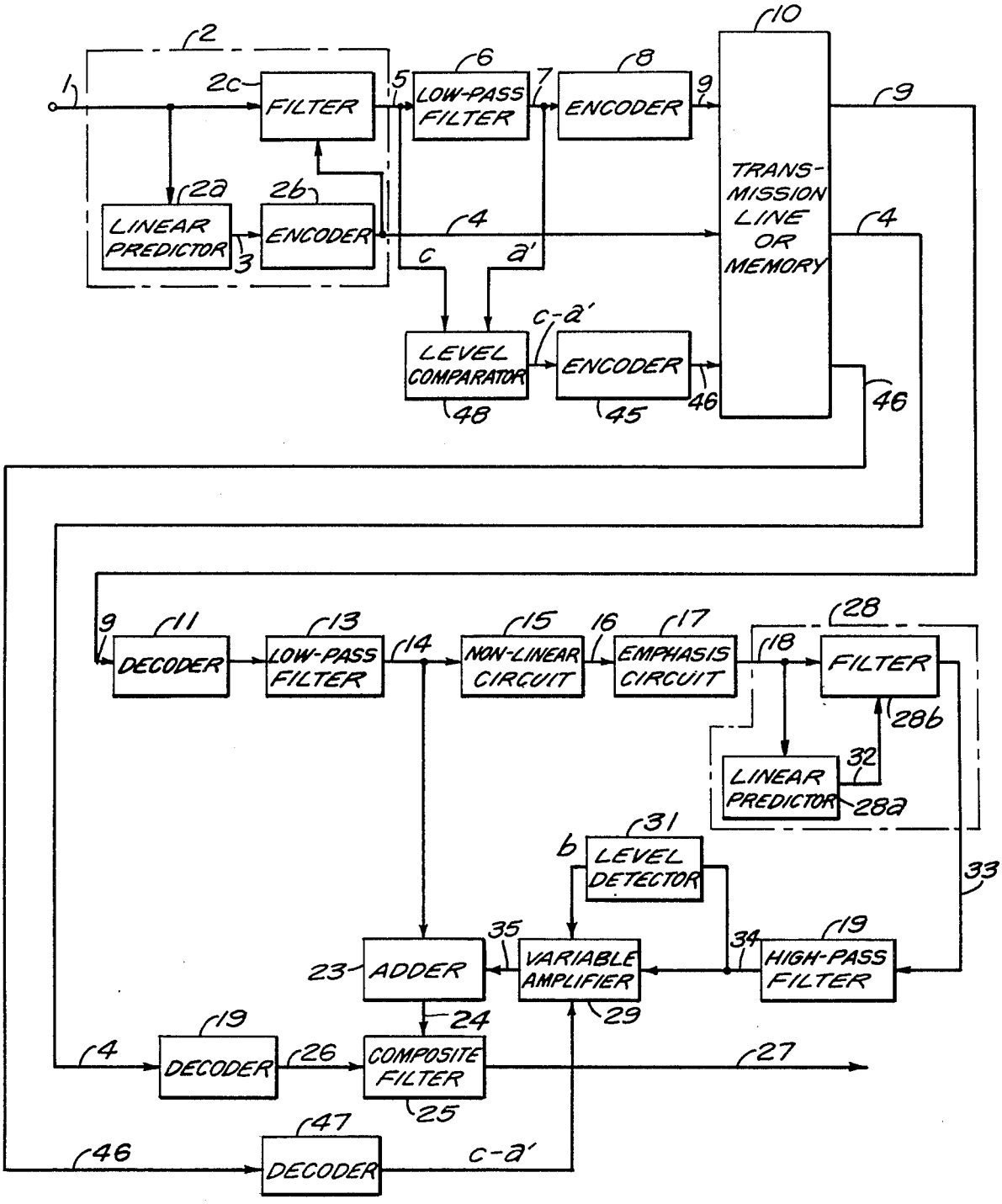

FIG. 9 shows still another embodiment of the present invention. This embodiment is conceived from the same principle as that of FIG. 8 but is different therefrom in that the level difference (c-a') between the level c of the predicting error signal 5 and the level a' of the base band component 7 is computed and encoded on the encoding side in advance of the transmission or storage. In other words, the difference between the level c and a' before and after the low-pass filter 6 is calculated by the level comparator 48 and encoded by an encoder 45. The variable gain amplifier 29 is controlled to have the gain c-a'/b for supplementing the level difference (c-a') from the level difference (c-a') decoded by the decoder 47 and the level b of the high frequency component 34. In the case of this embodiment, the transmission of the level difference (c-a') is required too. The increase of information, however, is as negligibly small as the case of FIG. 8 and the quality of the composite voice is remarkably improved.

As described by referring to the embodiments, the present invention enables to make the short time frequency spectrum of the exciting signal as flat as the original predictive error signal and remarkably improves the quality of the composite voice. This invention therefore can achieve noteworthy effect for obtaining a high quality voice encoding and decoding device aiming low bit encoding.

What we claim is:

1. A voice encoding and decoding device comprising a first predictor consisting of a linear predictor which analyzes an input voice to a predictive parameter, a first encoder which is connected to said linear predictor and encodes the predictive parameter and a first filter whose frequency characteristics are controlled by the encoded predictive parameter and which outputs a predictive error signal, a low-pass filter which is connected to said first filter and passes only a base band component of the predictive error signal, a second encoder which is connected to said low pass filter and encodes the base band component, transmission or memory means which is connected to said first and second encoders and transmits or stores the encoded base band component and the encoded predictive parameter, first and second decoders which are connected to said transmission or memory means, said first decoder decoding the encoded base band component, and said second decoder decoding the encoded predictive parameter, a nonlinear circuit which is connected to said first decoder via a low pass filter and produces a higher harmonic component of the base band component, an emphasis circuit which is connected to said nonlinear circuit and emphasizes the high frequency range of the higher harmonic component, a second predictor which is connected to said emphasis circuit and consists of a second linear predictor and a filter whose frequency characteristics are controlled by a predictive parameter of said second linear predictor, a high-pass filter which is connected to said second predictor and which produces a high frequency output signal component having a flat high frequency range spectrum, level detecting means which receives said high frequency component and said base band component and detects the level difference therebetween, a variable gain amplifier which is connected to said level detecting means and compensates to equalize the level of said base band component with that of said high frequency component, an adder circuit which receives the base band component and the high frequency component of the same level and produces an exciting signal, and a voice composite filter which is connected to said adder circuit and said second decoder and composes said exciting signal and the decoded predictive parameter to reproduce a voice.

2. A voice encoding and decoding device as claimed in claim 1, wherein said level detecting means comprises a first level detector for detecting the level a of said decoded base band component and another level detector for detecting the input level b of said variable gain amplifier, said variable gain amplifier being operable at a gain a-b/b proportional to the level difference (a-b).

3. A voice encoding and decoding device as claimed in claim 1, wherein said level detecting means comprises a first level detector for detecting the level c of the predictive error signal out of said predictor of the encoding side, another level detector for detecting the level a of said base component and still another level detector for detecting the input level b of said high frequency component, said variable gain amplifier being operable at a gain c-a/b supplementing the level difference c-a between the predictive error signal before encoding and said decoded base band component.

4. A voice encoding and decoding device as claimed in claim 1, wherein said level detecting means comprises a level comparator detecting the level difference (c-a′) between the level c of said predictive error signal from said predictor before encoding and the level a′ of said base band component before encoding, and another level detector detecting the input level b of said high frequency component of said variable gain amplifier, said variable gain amplifier being operable at a gain c-a′/b supplementing the level difference (c-a′) of said level comparator.

* * * * *